US005232423A

United States Patent [19]

Hajduczek

[11] Patent Number: 5,232,423

[45] Date of Patent: Aug. 3, 1993

[54] EXERCISE APPARATUS

[76] Inventor: Richard J. Hajduczek, 509 Roanoke Dr., Martinez, Calif. 94553

[21] Appl. No.: 900,266

[22] Filed: Jun. 18, 1992

[51] Int. Cl.[5] ..... A63B 22/20

[52] U.S. Cl. ..... 482/68; 482/66

[58] Field of Search ..... 482/70, 71, 66, 68

[56] References Cited

U.S. PATENT DOCUMENTS

| | | | |
|---|---|---|---|
| 2,969,060 | 1/1961 | Swanda et al. . | |
| 3,559,986 | 6/1968 | Ehrmantraut . | |
| 3,756,595 | 9/1973 | Hague . | |
| 3,834,693 | 9/1974 | Poppenberger . | |
| 3,912,260 | 10/1975 | Rice . | |
| 4,132,404 | 1/1979 | Wilson . | |
| 4,340,214 | 7/1982 | Schutzer | 482/71 |
| 4,542,898 | 9/1985 | Grushkin . | |
| 4,781,372 | 11/1988 | McCormack . | |
| 4,846,463 | 7/1989 | Kleinnibbelink | 482/71 |
| 4,906,192 | 3/1990 | Smithard et al. . | |
| 4,946,160 | 8/1990 | Bertoletti | 482/71 |
| 4,953,858 | 9/1990 | Zelli | 482/71 |

FOREIGN PATENT DOCUMENTS

| | | | |
|---|---|---|---|
| 0579401 | 9/1976 | Switzerland | 482/71 |

*Primary Examiner*—Richard J. Apley
*Assistant Examiner*—Lynne A. Reichard
*Attorney, Agent, or Firm*—Thomas R. Lampe

[57] ABSTRACT

Apparatus for exercising and developing lower extremity muscles including a concave track in a form of a circular segment having a predetermined radius and a platform movable along the track. The track is so configured as to allow the primary axis of a user's body to remain essentially normal to the portion of the track in registry with the platform during use so that reactive forces from the track will be directed substantially along the primary axis to promote stability.

5 Claims, 3 Drawing Sheets

EXERCISE APPARATUS

TECHNICAL FIELD

This invention relates to exercise apparatus, and more particularly, to apparatus for exercising and developing lower extremity muscles. The apparatus also improves the user's cardiovascular capacity.

BACKGROUND ART

A great many forms and variations of exercise equipment are known in the prior art. Many such devices are dedicated types of exercise and training equipment; that is, equipment specifically devised to develop certain muscles or muscle groups. For example, the following patents are concerned, at least to some degree, with the exercise and development of leg muscles: U.S. Pat. No. 4,340,214, issued Jul. 20, 1982, U.S. Pat. No. 4,906,192, issued Mar. 6, 1990, U.S. Pat. No. 3,834,693, issued Sep. 10, 1974, U.S. Pat. No. 3,912,260, issued Oct. 14, 1975, U.S. Pat. No. 4,781,372, issued Nov. 1, 1988, U.S. Pat. No. 4,542,898, issued Sep. 24, 1985, U.S. Pat. No. 3,756,595, issued Sep. 4, 1973, U.S. Pat. No. 3,559,986, issued Feb. 2, 1971, U.S. Pat. No. 4,132,404, issued Jan. 2, 1979, and U.S. Pat. No. 2,969,060, issued Jan. 24, 1961.

A number of the devices disclosed in the above-identified prior art patents are characterized by their relative complexity and high expense. Furthermore, a number of such mechanisms are not intended for a general workout of all the muscles of the lower extremities but instead are devoted to muscles or muscle groups employed when carrying out certain specified activities such as skiing or skating. Also inherent in some of the prior art constructions is the fact that the user is placed, at least on occasion, in positions which are inherently unstable. This can cause falls and consequent injuries.

U.S. Pat. No. 4,340,214 is worthy of special comment. The training apparatus disclosed in such patent is for skaters and consists of a fixed training stand with two carriages transversely displaceable in opposite directions. Each carriage has a platform for attachment to one of the skater's feet and the platforms alter their angle of inclination upon displacement of the associating carriage from the initial position to provide some semblance of the action which occurs when a skate cuts the ice.

Lateral resistance to movement of the user's feet is provided through the combination of a straight inclined ramp and spring elements which are stretched as the user's foot moves up the ramp. Foot movement is rather limited in that each foot can only traverse a path extending outwardly from a midpoint location. Obviously, with such an arrangement, the user's body is continuously unbalanced and thus unstable. In fact, the device of U.S. Pat. No. 4,340,214 utilizes side platforms engaged by the shoulder of the user.

U.S. Pat. No. 3,834,693 illustrates a ski instruction apparatus featuring two independently movable platforms disposed on rails attached to a turntable. U.S. Pat. No. 3,559,986 discloses rollably mounted dollies for leg exercises. The dollies are independently movable in straight horizontally disposed pathways.

DISCLOSURE OF INVENTION

The present invention relates to apparatus which is relatively simple and low cost, yet exercises and develops virtually all muscles of the lower extremities, in particular, quadriceps, hamstrings and gluteus. Furthermore, the apparatus develops balance, coordination and proprioception. The cardiovascular capacity of the user is improved.

The exercise apparatus is so constructed as to provide user stability, since reactive forces occasioned by exercise carried out on the apparatus are always directed along the length of the user's body. No springs or other biasing arrangements which might wear or break are incorporated in the apparatus.

As will be seen below, during use of the apparatus the exerciser's entire body is in motion, giving the sensation of free movement. This is to be contrasted with many prior art exercise devices wherein much of the users body remains relatively stationary, for example, treadmills and ski simulators. The present apparatus provides sensations more akin to those found in skateboarding and surfing, greatly adding to the enjoyment of the work-out or exercise.

Apparatus constructed in accordance with the teachings of the present invention is for the purpose of exercising and developing lower extremity muscles. The apparatus incorporates track means including at least one generally smoothly curved track having distal ends and a track mid-section.

Support means is provided for supporting the track means on a surface so that the track is concave with the track midsection adjacent to the surface and the distal ends projecting upwardly therefrom and elevated with respect to the track midsection.

Platform means is provided for supporting the feet of an individual. The platform means includes at least one platform engageable by the feet and roller means connected to the platform and engageable and movable with respect with at least one track.

The at least one track is so configured as to allow the primary axis of a user's body to remain essentially normal to the portion of the at least one track in registry with the platform means during use of the apparatus whereby reactive forces from the track will be directed substantially along the primary axis of the user's body regardless of placement of the platform means on the track.

In the preferred embodiment of the invention, the platform means comprises a single platform having a support surface for maintaining the user's feet closely adjacent and substantially aligned with the user's body. The track is in the form of a circular segment having a predetermined radius falling within a specified range.

Other features, advantages, and objects of the present invention will become apparent with reference to the following description and accompanying drawings.

BEST MODE FOR CARRYING OUT THE INVENTION

Figure 3:
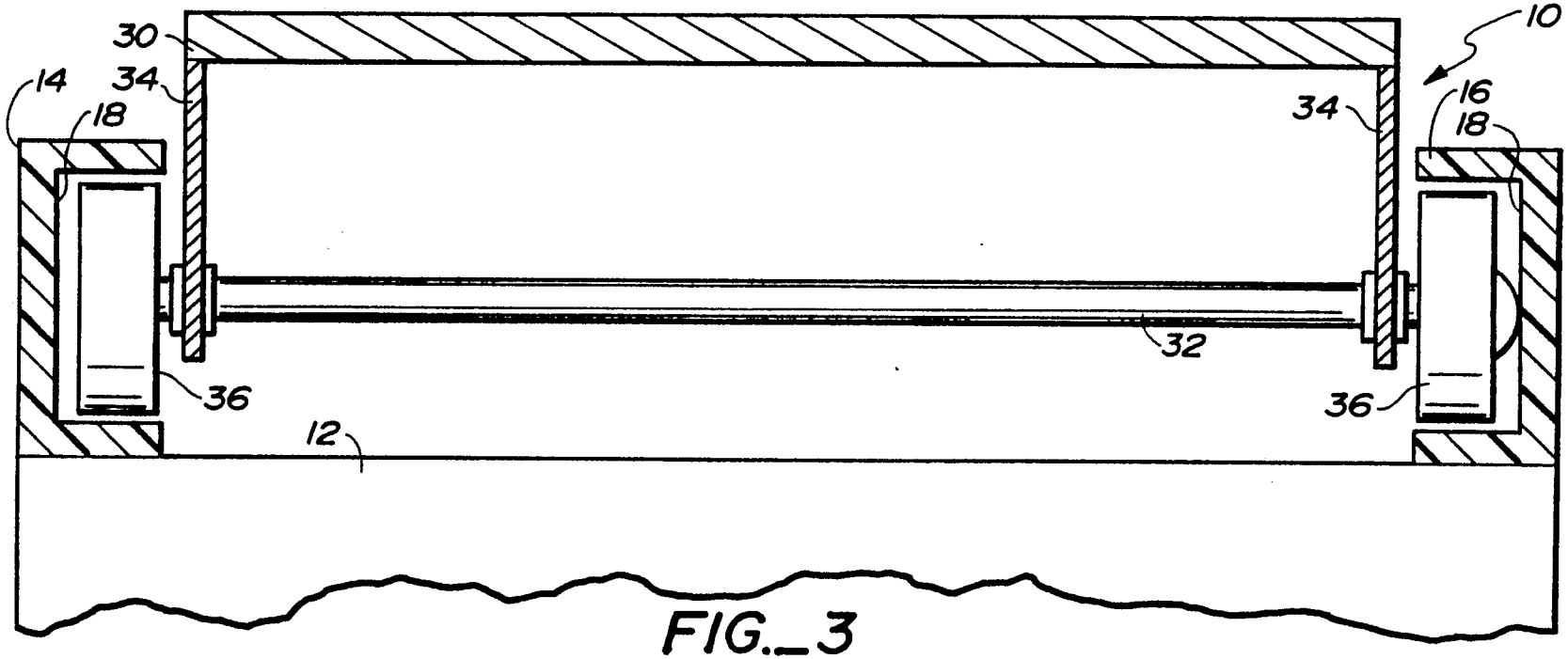
FIG. 3 is a greatly enlarged, cross-sectional, side elevation view of platform means and track means incorporated in the apparatus.

Referring now to the drawings, apparatus constructed in accordance with the teachings of the present invention is generally designated by reference numeral 10. The apparatus includes a support 12 upon which are mounted a pair of tracks 14, 16. As may be seen with reference to FIG. 3, tracks 14 and 16 are in the form of channels open at the opposed inner sides thereof to define recesses 18. Tracks having cross-sectional configurations differing from that of tracks 14, 16, e.g. circular tubing, may of course be employed without departing from the scope of the present invention.

The tracks are parallel and each of the tracks is concave. The track midsections 20 are located adjacent to the surface supporting the apparatus with the distal ends 22, 24 thereof projecting upwardly from the midsection and elevated with respect thereto. The tracks may be formed of any suitable material such as steel or aluminum.

Platform means is provided for supporting the feet of an individual. The platform means includes a platform 30 having an upper support surface engageable by the user's feet and for maintaining same closely adjacent to and substantially aligned with the user's body. Two axles 32 (only one of which is illustrated, in FIG. 3) extend through bearings formed in side plates 34 of the platform. Wheels 36 are connected to the ends of the axles 32 and disposed within recesses 18 of the tracks 14, 16. Thus, the entire platform means is free to traverse the path defined by the curved tracks.

Figure 1:
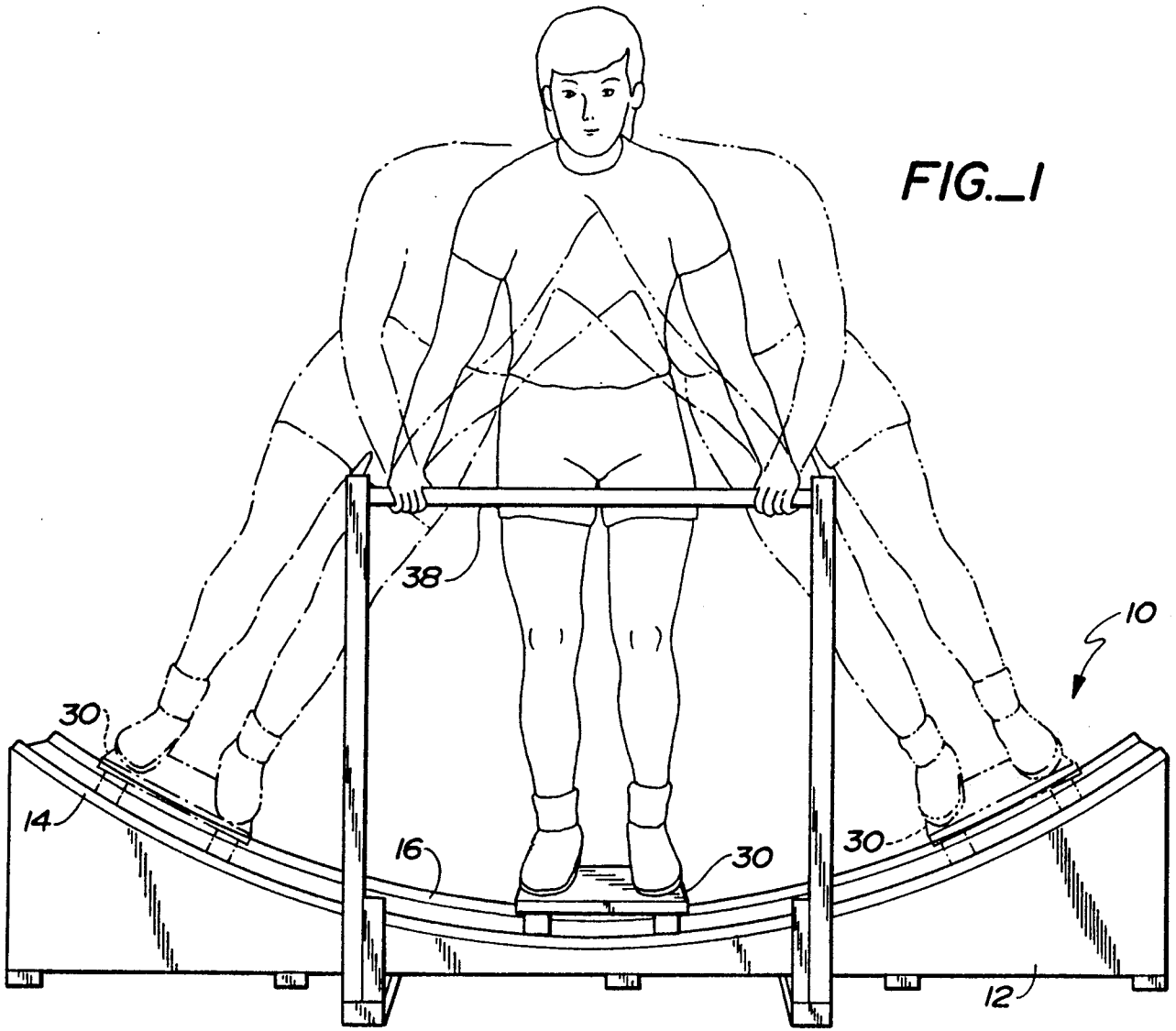
FIG. 1 is a perspective, frontal view of apparatus constructed in accordance with the teachings of the present invention being used by an individual and illustrating alternative positions assumed by such individual while maintaining contact with a hand rail.

To utilize the apparatus 10, an individual stands on the platform 30 as shown in FIG. 1 with the platform disposed at the lowermost location of the tracks. A hand rail 38 is positioned closely adjacent to the support 12 and manually grasped by the individual. He or she then exerts sidewise forces on the platform means so that his or her body is angled to the right or left as shown in phantom lines. It will be appreciated that the user's feet can move back and forth between the extremes of the tracks or rails as shown in FIG. 1, much in the nature of a pendulum. Beginners will probably choose to maintain contact with the hand rail during this phase of the exercise.

Figure 2:
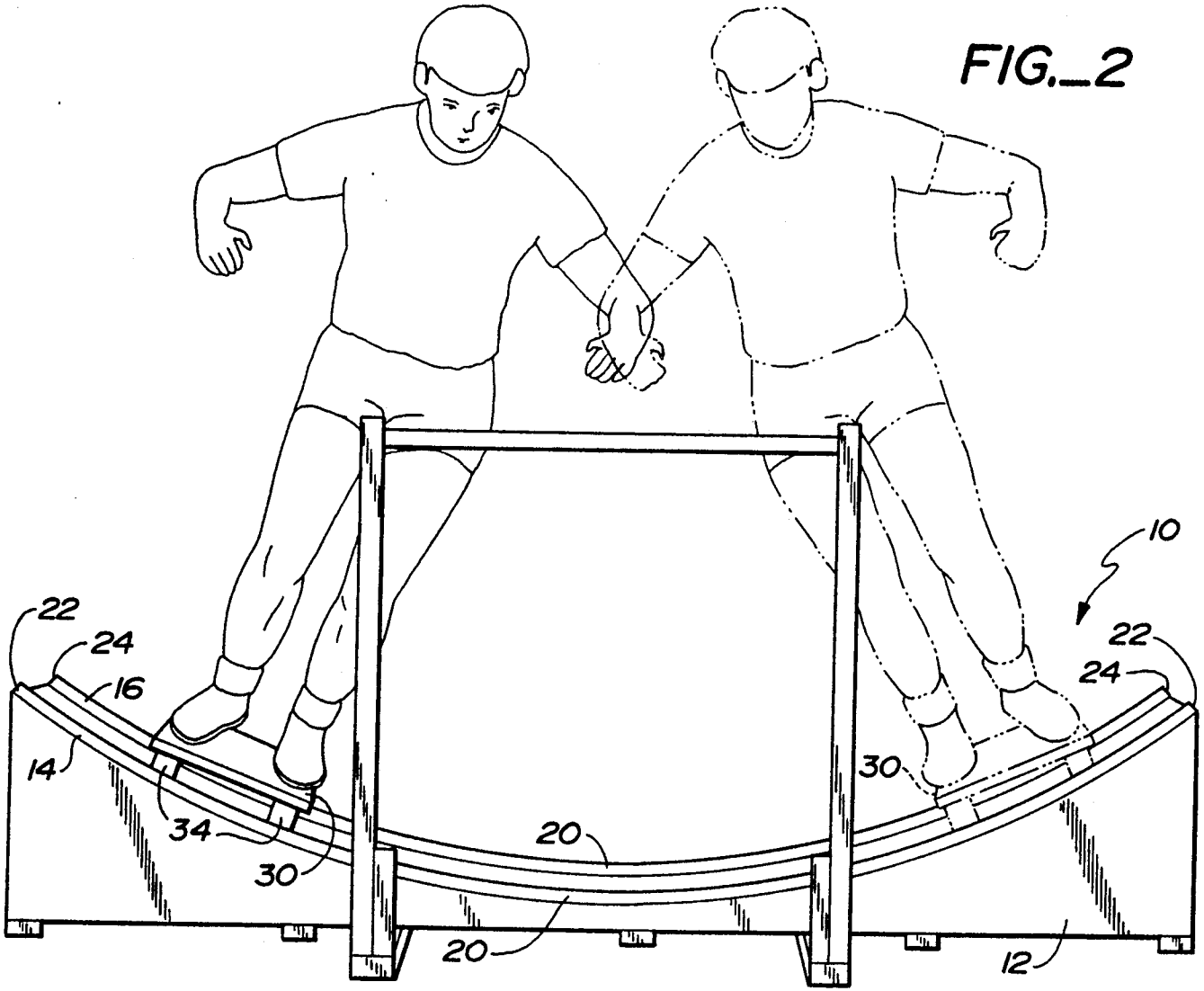
FIG. 2 is a view similar to FIG. 1, but illustrating two alternative positions assumed by an individual using the apparatus and not maintaining contact with the hand rail.

Referring now to FIG. 2, the person supported by the platform 30 can readily attain the proficiency enabling him or her to let go of the hand rail and traverse the length of the tracks 14, 16 merely by flexing his or her knees when the platform approaches the distal ends 22, 24 of the tracks and by straightening his or her legs as downward movement of the platform 30 to the lowermost midsection of the tracks takes place. That is, the user's legs are substantially straight at the bottom of the track concavity and flexed near the upper extent of the tracks.

It may be seen that the primary axis of the user's body remains substantially normal to the portion of the tracks in registry with the platform during use of the apparatus. This means that reactive forces from the tracks will be directed substantially along the primary axis of the user's body regardless of placement of the platform on the track. This creates a highly stable condition since the user's body is never off balance to any significant degree. This is to be compared with an arrangement wherein the tracks are convex rather that concave.

To maintain such a relationship between the user's body and the apparatus, the tracks 14, 16 are in the form of circular segments having a predetermined radius. The predetermined radius is preferably in the range of from about three feet to about twelve feet, and even more preferably, in the range of from about four feet to about eight feet. Tracks having radii falling outside the specified range are difficult if not impossible to use and do not provide the advantages of the present apparatus. Insofar as length of the tracks is concerned, it is preferred that the track be at least about three feet in total length. The concave configuration of the tracks readily enables the lengths thereof to be extended, if so desired.

I claim:

1. Apparatus for rexercising and developing lower extremity muscles, said apparatus comprising, in combination:

track means comprising two parallel, generally smoothly curved tracks, each track having spaced distal ends and a track midsection;

support means for supporting said tracks on a surface so that the tracks are concave with each said track midsection adjacent to said surface and the distal ends of each track projecting upwardly therefrom and elevated with respect to said track midsection, said tracks being fixedly positioned relative to each other by said support means and defining fixed, parallel, smoothly curved paths of movement disposed in parallel planes; and platform means for supporting the feet of an individual, said platform means comprising a single, unitary platform having a support surface for supporting said feet and roller wheels connected to said single, unitary platform rotatable about axes fixed relative to said support surface, said roller wheels engaging both of said tracks and movable with respect to said tracks along said fixed, parallel, smoothly curved paths of movement in said parallel planes, and said single, unitary platform maintaining said feet closely adjustment to and a fixed distance from roller wheels, aligned with the body of the individual, and disposed at right angles to said parallel planes, said tracks being so configured as to allow the primary axis of a user's body to remain essentially normal to the portions of the tracks in registry with said platform means during use of the apparatus whereby reactive forces from said tracks will be directed substantially along said primary axis regardless of placement of said platform means on said tracks when the individual moves sideways along said tracks on said platform means.

2. The apparatus according to claim 1 wherein the track is in each form of a circular segment having a predetermined radius.

3. The apparatus according to claim 2 wherein said predetermined radius is in the range of from about three feet to about twelve feet.

4. The apparatus according to claim 2 wherein said predetermined radius is in the range of from about four feet to about eight feet.

5. The apparatus according to claim 1 wherein each said track is at least about three feet in length.

* * * * *